US006013176A

United States Patent [19]

Greaney et al.

[11] Patent Number: 6,013,176

[45] Date of Patent: Jan. 11, 2000

[54] METHOD FOR DECREASING THE METALS CONTENT OF PETROLEUM STREAMS

[75] Inventors: Mark Alan Greaney, Upper Black Eddy, Pa.; Roby Bearden, Jr.; Michael Charles Kerby, both of Baton Rouge, La.

[73] Assignee: Exxon Research and Engineering Co., Florham Park, N.J.

[21] Appl. No.: 09/216,573

[22] Filed: Dec. 18, 1998

[51] Int. Cl.[7] ..... C10G 17/00

[52] U.S. Cl. ..... 208/251 R; 208/284

[58] Field of Search ..... 208/251 R, 284

[56] References Cited

U.S. PATENT DOCUMENTS

| | | | |
|---|---|---|---|
| 2,902,428 | 9/1959 | Kimberlin, Jr. et al. | 208/251 R |
| 3,971,713 | 7/1976 | Ellender, Jr. | 208/226 |
| 4,752,379 | 6/1988 | Delaney | 208/251 R |
| 4,773,988 | 9/1988 | Delaney | 208/251 R |
| 4,915,818 | 4/1990 | Yan | 208/251 R |
| 5,282,959 | 2/1994 | Roling et al. | 208/251 R |
| 5,626,742 | 5/1997 | Brons et al. | 208/251 R |
| 5,683,626 | 11/1997 | Sartori et al. | 252/389.62 |
| 5,746,907 | 5/1998 | Wielers et al. | 208/251 R |
| 5,817,228 | 10/1998 | Greaney et al. | 208/251 R |

FOREIGN PATENT DOCUMENTS

| | | | |
|---|---|---|---|
| WO 97/08270 | 6/1997 | WIPO | C10G 19/00 |
| WO 97/08271 | 6/1997 | WIPO | C10G 19/00 |
| WO 97/08275 | 6/1997 | WIPO | C10G 71/00 |

OTHER PUBLICATIONS

Kalichevsky et al, Petroleum Refining With Chemicals, Elsevier Publishing Company, Chapter 4, pp. 136–183 (1956).

Collins et al, "Oxidative desulphurisation of oils via hydrogen peroxide and heteropolyanion catalysis", Journal of Molecular Catalysis A: Chemical, 117, pp. 397–403 (1997).

Gould, "Oxidative demetallization of petroleum asphaltenes and residua", FUEL, vol. 59, pp. 773–736. (Oct. 1980).

Halpern, Phase–Transfer Catalysis, vol. A19, pp. 293–298.

Branthaver, "Influence of Metal Complexes in Fossil Fuels on Industrial Operations", Chapter 12, American Chemical Society Symp. Series No. 344 (1987).

Ovalles et al, "Upgrading of Orinoco Belt crude oil and its fractions. . .", Fuel Processing Technology 48 (1996), pp. 159–172.

*Primary Examiner*—Helane Myers
*Attorney, Agent, or Firm*—Linda M. Scuorzo

[57] ABSTRACT

The invention relates to a process for demetallating a petroleum stream by contacting a metals-containing petroleum feed in the presence of a base selected from Group IA and IIA hydroxides and carbonates and ammonium hydroxide and carbonates and mixtures thereof an oxygen containing gas and a phase transfer agent at a temperature of up to 180° C. for a time sufficient to produce a treated petroleum feed having a decreased metals content. The invention provides a method for enhancing the value of petroleum feeds that traditionally have limited use in refineries due to their metals, e.g., Ni and V content.

9 Claims, No Drawings

METHOD FOR DECREASING THE METALS CONTENT OF PETROLEUM STREAMS

FIELD OF THE INVENTION

The present invention relates to a method for demetallating petroleum feedstreams.

BACKGROUND OF THE INVENTION

Petroleum streams that contain metals are typically problematic in refineries as streams because the metallic components contained therein have a negative impact on certain refinery operations. Thus, demetallation has been referred to as critical to help conversion of crude fractions (see, e.g., Branthaver, Western Research Institute in Chapter 12, "Influence of Metal Complexes in Fossil Fuels on Industrial Operations", Am. Chem. Soc. Simp. Series No. 344 (1987)).

The presence of such metals prevents more advantageous use of the petroleum stream by rendering especially the heaviest oil fractions (in which these metal containing structures concentrate) less profitable to upgrade, and when these resources are used they make catalyst replacement/disposal expensive. Current refinery technologies typically address the problem by using metal containing feedstreams as a less preferred option, and by tolerating catalyst deactivation when there are not other feedstream alternatives available.

Treatment of petroleum resids to remove metals in the presence of air and a 50% NaOH solution with strong oxidants (sodium hypochlorite and peroxyacetic acid) are disclosed in Gould (Fuel, Vol. 59, p. 733, October 1980). Gould disclosed negligible metals removal with NaOH and air and none with air even at 100° C. By contrast essentially no demetallation was therein achieved in when a weak oxidizing agent was used. It was concluded that stronger oxidants than air were required.

U.S. Pat. No. 3,971,713 discloses a process for desulfiarizing crude oils using solid calcium hydroxide at atmospheric pressure. Vanadium removal is also disclosed. However, the process is carried out at temperatures below about 100° F. because desulfurization decreases at higher temperatures. The addition of water had a detrimental effect on the process as well. This would suggest that the use of aqueous calcium hydroxide is precluded. Thus, process would be of limited application for treatment of resids, which are characterized by much higher viscosities than whole crude.

By contrast there exist a body of art related to the removal of non-metals, e.g., sulfur which use phase transfer agents but typically require the presence of a strong oxidizing agent such as $H_2O_2$ (see, e.g., Collins, et al., J. Molecular Catalysis A: Chemical 117, 397–403 (1997)). Additionally, use of the oxidant often also must be combined with additional processing steps (e.g., adsorption) in order to remove the oxygenated sulfur compounds from the treated stream. Treatment of petroleum feeds with base has been practiced to remove certain acids see, e.g., Kalichevsky and Kobe, eds., *Petroleum Refinery With Chemicals*, Elsevier Publ., 1956; Sartori, et al, International Application No. PCT/US96/13688 (International Publ. No. WO 97/08270) which discloses treatment with Group IA or IIA oxides, hydroxides or hydrates. U.S. Pat. No. 5,683,626 which discloses treatment of with tetraalkylammonium hydroxides to decrease crude acidity.

One skilled in the art would not expect that processes for removal of sulfur or naphthenic acids would be applicable to selective demetallation of petroleum streams because sulfur naphthenic acids is not a metal and would not be expected to behave as such.

It would be desirable to develop a process that would permit demetallation to be carried out at mild process conditions using air or oxygen rather than the stronger oxidizing agents ($H_2O_2$ and stronger) that are typically used and in the absence of added water to minimize volumes handled.

SUMMARY OF THE INVENTION

The present invention provides for a method for removing metals, preferably Ni and V, from petroleum streams containing these metals. In one embodiment the process provides for a process for demetallating a petroleum stream, by contacting a metals-containing petroleum feed in the presence of a solid base selected from Group IA and IIA oxides, hydroxides and carbonates and ammonium hydroxide and carbonates and mixtures thereof, an oxygen containing gas and a phase transfer agent at a temperature of from 100° C. to 180° C. for a time sufficient to produce a treated petroleum feed having a decreased metals content.

The process may also be used to remove metals, such as Fe, that are more easily removed than Ni and V.

The present invention may suitably comprise, consist or consist essentially of the described elements and may be practiced in the absence of an element not disclosed.

DETAILED DESCRIPTION OF THE INVENTION

The present invention provides for a method for demetallating and ultimately the demetallation (particularly of metal species typically associated with hydrocarbon species and thus hydrocarbon soluble, e.g., petroporphyrins) of a the metals in a metals-containing hydrocarbonaceous petroleum stream by contacting a petroleum stream (also referred to herein as a fraction, feedstream or feed) containing the metals in the presence of solid a base selected from Group IA oxides, hydroxides and carbonates and ammonium hydroxide and carbonates and mixtures thereof, an oxygen-containing gas and at least one phase transfer agent at an effective temperature of from 100° C. to 180° C. to produce a treated petroleum stream or fraction having an enhanced extractable metals content. The contacting is carried out at a pressure that corresponds to the reaction temperature and is typically less than 10,000 kPa.

The oxygen containing gas is suitably an effective concentration of air or oxygen to produce enhanced extractability and ultimately demetallation under process conditions.

The base may be a solid in suitable form such as a powder, as a suitable slurry (i.e., a solid in oil dispersion) or in a fixed or fluid bed. Additionally, the base may be in molten form either alone or in combination with the phase transfer agent. Additional means of engineering the bed or flow are known to those in the art. The base may be supported on refractory high surface area materials such as activated carbons, silica, alumina, clays and the like. This may be accomplished by methods known in the art. Base is present in an effective demetallating amount, typically a ratio of 0.025 to 0.25 base to oil.

The phase transfer agent is present in a sufficient concentration to decrease the metals content of the starting feed. The phase transfer agent may be miscible or immiscible with the petroleum stream to be treated. Typically, this is influenced by the length of the hydrocarbyl chain in the molecule and may be selected by one skilled in the art. While this may vary with the agent selected typically concentrations of 0.1 to 10 wt% are used. Examples include quatemary ammonium salts, quaternary phosphonium salts, crown ethers, and open-chain polyethers such as polyethylene glycols, and others known to those skilled in the art either supported or unsupported.

While process temperatures of from 100° C. to 180° C. are suitable, lower temperatures of less than 150° C., less than 120° C. are can be used depending on the nature of the feed and phase transfer agent used.

The metallic components that may be treated include Ni and V species, as these are typically present in petroleum streams. Transition metals such as Ni and V are often found, for example, in porphyrin and porphyrin-like complexes or structures, and are abundant in heavy petroleum fractions. In these feeds such metal species tend to be found in non-water soluble or water-immiscible structures. However, hydrocarbon soluble metals components of petroleum streams traditionally have been difficult to treat and have required the use of strong oxidizing agents or application of high temperatures and/or high pressures, particularly when mild oxidizing agents have been used. Petroleum streams are complex mixtures of many different types of reactive and unreactive species. As such the ability to successfully treat particular components of petroleum streams or fractions is not readily predictable from the reactivity of and success in treating pure components.

The process of this invention also may be applied to the removal of metals that are more easily removed than Ni and V, such as Fe. However, since other processing options are available for removal of such other metals, the process is most advantageous for removal of the metals Ni, V, as these are typically more costly to remove. A benefit of the process of the present invention is in its ability to remove metals contained in typically non-water extractable metals containing moieties.

Examples of Ni and V metal-containing petroleum streams or fractions that may be treated according to the process of the present invention are metal containing carbonaceous and hydrocarbonaceous petroleum streams of fossil fuels such as crude oils and bituminous, as well as processed/distilled streams (distillation residues) such as coker oils, atmospheric and vacuum resids, fluid catalytic cracker feeds, metal containing deasphalted oils and resins, processed resids and heavy oils (heavy crudes) as these typically have a high metals content. These are typically 650° F.+(343° C.+) fractions.

The feed to be demetallated can have a range of metals content The average vanadium in the feed is typically about 5 ppm to 2,000 ppm, preferably about 20 to 1,000 ppm, by weight, most preferably about 20 to 100 ppm. The average nickel content in the starting feed is typically about 2 to 500 ppm, preferably about 2 to 250 ppm by weight, most preferably about 2 to 100 ppm. For example, a Heavy Arab crude may have a typical nickel content of 8 ppm and a vanadium content of 19 ppm by weight. However, any level of nickel and/or vanadium may be treated according to the present invention.

The metals containing petroleum feed to be treated preferably should be in a liquid or fluid state at process conditions. This may be accomplished by heating the material or by treatment with a suitable non-aqueous solvent as needed.

The actual method of contacting of base (either supported or unsupported) with the other components of the system (i.e., petroleum stream, phase transfer agent and oxidizing agent) is determined by the particular reactors chosen. The reactor system can be static/fixed (e.g., flowthrough, trickle bed, or the like) or dynamic (e.g., fluidized, slurried or ebullating). Each reactor system can consist of one or more stages in series. Particle size for the solid base should be compatible with the reactor system chosen. For example, 1/16 inch diameter particles may be used in a fixed bed reactor, whereas 100 micron (or smaller) particles can be used in a slurry reactor (either captive slurry or once-through). These parameters can be varied by one skilled in the art to accomplish the desired contacting. A goal of contacting is to achieve enhanced mixing among the various starting materials.

Gas mixing with petroleum stream can be accomplished using means known in the art, e.g., in high shear mixers or through the use of gas spargers. Gas bubble size can be adjusted to attain optimum performance in the reactor. Ideally, dispersed gas will comprise from about 5 to 50 vol% of the gas-liquid mixture in the reactor. Desirably a thin film of oil is brought into contact with base, phase transfer agent and oxygen to effect removal of metals.

Treated petroleum stream and phase transfer agent may be either co-recovered or recovered as individual streams depending on the solubility of the phase transfer agent in the petroleum stream. It is desirable that the phase transfer agent be chosen to one in which the demetallation products (i.e., the extractable metals) be soluble, and also desirable if the phase transfer agent were one that forms a separate phase from the treated petroleum stream as this can assist in isolation/separation of the treated petroleum stream from the metals therein.

Optionally, a metals-recovery step may be added, as needed, to recover the extracted metals. The nature of any step(s) used to isolate/recover the extracted metals from the treated petroleum stream depends on the nature of the bed/reactor, solubility or insolubility of the metals in the phase transfer agent and the nature and amount of the phase transfer agent and may be chosen by one skilled in the art.

Desirably, the process should be carried out for a time and at conditions within the ranges disclosed sufficient to achieve a decrease, preferably a maximum decrease, in the metals content of the metals containing petroleum stream. Contact can be achieved, e.g., by vigorous homogenization for the components of the mixture.

Reaction temperatures will vary with the particular petroleum stream due to its viscosity. However, temperatures may suitably range from about ambient to about 180° C. and corresponding pressures of from 0 kPa to 10,000 kPa. An increase in temperature may be used to facilitate removal of metal species within the process conditions disclosed. A liquid or fluid phase or medium should be maintained.

Following demetallation, the product petroleum stream contains a reduced level of metals, e.g., Ni and/or V and/or Fe content While the actual amount removed will vary according to the staring feed, on average, vanadium levels of not more than about 15 ppm by weight, preferably less than about 4 ppm and on average nickel levels of less than about 10 ppm, preferably less than about 2 ppm can be achieved. Greater than 30 percent by weight of the total vanadium and nickel can thereby be removed.

The metal contaminant-decreased (e.g., upgraded) product may be used in refining operations that are adversely affected by higher levels of metals, for example fluid catalytic cracking or hydroprocessing, or such a product can be blended with other streams of higher or lower metals content to obtain a desired level of metallic contaminants.

A benefit to the present invention is that the process may be operated under mild temperatures and pressures and mild oxidizing conditions resulting in a minimization of undesirable side reactions and an enhancement of yield also may be achieved.

The invention may be demonstrated with reference to the following examples:

EXAMPLE 1

One hundred grams of a deasphalted vacuum reside was combined with 48 grams of powdered potassium hydroxide (Fluka) and 25 grams of polyethyleneglycol 400. This mixture was subjected to homogenization/dispersion in a one liter glass beaker using a Beckman Model 300 Homogenizer, fitted with a standard generator with saw teeth. The glass vessel was heated with a heating mantle to 100° C. After 30 minutes, the homogenizer and heating mantle were turned off and the contents of the flask were transferred to a beaker. Upon cooling, a solid separated spontaneously on the bottom of the flask. The reside was poured off of the solid which remained adhered to the glass. The beaker and solid was rinsed several times with toluene (200 ml) and the rinses were combined with the reside. The solid appeared to be a mixture of polyethyleneglycol and potassium hydroxide and had a dry weight of 72 g. The toluene was stripped from the residuum by use of a rotovap. The initial reside contained 11.9 ppm vanadium and 6.7 ppm nickel. The product reside contained 3.8 ppm vanadium and 3.8 nickel by Inductively Coupled Plasma (ICP) Analysis.

EXAMPLE 2

One hundred grams of a deasphalted vacuum residuum was combined with 48 grams of powdered calcium hydroxide (Aldrich) and 25 grams of polyethyleneglycol 400. This mixture was subjected to homogenization/dispersion in a one liter glass beaker using a Beckman Model 300 Homogenizer, fitted with a standard generator with saw teeth. The glass vessel was heated with a heating mantle to 100° C. After 30 minutes, the homogenizer and heating mantle were turned off and the contents of the flask were transferred to a beaker. Two hundred milliliters of toluene was added to the reside upon cooling. The solution was filtered through a fine glass frit isolating a fine powdery light solid. This solid was rinsed with toluene and dried. Dry weight of solid was 49 g. The solid appeared to be calcium hydroxide. The reside/toluene filtrate was washed three times with 100 milliliters of distilled water to extract any polyethylene-glycol. The toluene was stripped from the reside by use of a rotovap. The vanadium content of the residuum was analyzed by Electron Spin Resonance (ESR). The initial reside contained 11.9 ppm vanadium. The product residuum contained 9.1 ppm vanadium.

Comparative Example 1

The same procedure was followed as in Example 2, except that the feed used was a vacuum residuum and no phase transfer catalyst (polyethylene glycol 400) was used. The vanadium content was 85 ppm; the final product equaled that of the starting material.

What is claimed is:

1. A process for decreasing the metals content of a petroleum stream, comprising:

contacting a metals-containg petroleum feed in the presence of a base selected from Group IA and Group IIA oxides, hydroxides and carbonates and ammonium hydroxide and carbonates and mixtures thereof an oxygen containing gas and a phase transfer agent at a temperature of from 100° C. to 180° C. for a time sufficient to produce a treated petroleum feed having an enhanced extractable metals content.

2. The process of claim 1 wherein the base is selected from NaOH and KOH and mixtures thereof.

3. The process of claim 1 wherein the phase transfer agent is selected from tetraalkylammonium hydroxide tetraalkylammonium salts and polyethylene glycols.

4. The process of claim 1 wherein the phase transfer agent is selected from tetraakyl ammonium salts, quaternary phosphonium salts, crown-ethers and open chain polyethers.

5. The process of claim 1 wherein the oxygen containing gas is selected from air and oxygen.

6. The process of claim 1 wherein the base is present in a weight ratio of 0.025 to 0.25 base to oil.

7. The process of claim 1 wherein the phase transfer agent is present in an amount of 0.1 to 10 wt.

8. The process of claim 1 wherein the base is supported on a refractory high surface area support.

9. The process of claim 1 further comprising recovering and recycling the phase transfer agent to treat fresh petroleum feed.

* * * * *